United States Patent [19]

Oshinsky

[11] 4,124,057

[45] Nov. 7, 1978

[54] COUPLER PATTERN FOR A RAILWAY VEHICLE

[75] Inventor: Frank W. Oshinsky, McKeesport, Pa.

[73] Assignee: McConway & Torley Corporation, Pittsburgh, Pa.

[21] Appl. No.: 815,324

[22] Filed: Jul. 13, 1977

[51] Int. Cl.[2] ..... B22C 7/00; B22C 9/22

[52] U.S. Cl. ..... 164/249; 164/368

[58] Field of Search ..... 164/247, 249, 235, 368, 164/369, 370; 249/184

[56] References Cited

U.S. PATENT DOCUMENTS

| | | | |
|---|---|---|---|
| 445,812 | 2/1891 | Kuhn | 164/247 |
| 1,028,601 | 6/1912 | Pipher | 164/247 |
| 3,138,835 | 6/1964 | Van Patten | 164/368 X |
| 3,830,285 | 8/1974 | Schrader, Jr. | 164/249 |
| 4,044,815 | 8/1977 | Smashey et al. | 164/249 X |

*Primary Examiner*—Robert L. Spicer, Jr.

*Attorney, Agent, or Firm*—Thomas H. Murray; Clifford A. Poff

[57] ABSTRACT

The drag pattern for a standard AAR coupler is modified to increase the thickness of the bottom wall of a coupler casting forwardly and rearwardly of a plane containing the horn line. The increased thickness is achieved by forming a substantially planar bottom wall surface for a distance of at least two inches at either side of a plane containing the horn line. Head and shank pattern parts are interchangeable and releasably secured onto a pattern plate for molding foundry sand in the drag portion of a foundry mold to produce E, E/F and F-types of coupler castings.

5 Claims, 4 Drawing Figures

COUPLER PATTERN FOR A RAILWAY VEHICLE

BACKGROUND OF THE INVENTION

This invention relates to improvements in a pattern used to cast a coupler for a railway vehicle and, more particularly, to providing such a coupler having an increased bottom wall thickness both forwardly and rearwardly of a plane coinciding with the horn line of the coupler to strengthen the coupler casting and facilitate the use of interchangeable head and shank pattern portions on a pattern plate used to mold foundry sand.

As is known in the art, various different forms of standard type couplers are used to couple together railway vehicles. The standard forms of E-type, E/F-type and F-type couplers include a unitary casting consisting of two major component parts, namely a coupler head and a coupler shank. The horn line is a transverse plane conventionally used as a demarcation between the coupler head and the coupler shank. The bottom wall, forwardly of the horn line in the coupler head and rearwardly from the horn line in the coupler shank. is a critical area where cracks and even failure of the metal occur because of service stress and fatigue. Spaced by a relatively short distance that varies with the particular type of coupler casting, the bottom wall is provided with a cast recess wherein a wear plate is attached to engage a coupler carrier. The bottom wall from the lock chamber in the coupler head to the recess in the shank for the wear plate is not uniformly thick because the bottom wall in this area is a transition wall between the coupler head and coupler shank. The thickness of this portion of the bottom wall is also a function of the core member used to form the lock chamber and other internal surfaces in the coupler head. The lock chamber is formed by a core which also extends along the shank and forms a hollow section therein.

In application Ser. No. 815,325, filed July 13, 1977 and assigned to the same Assignee as this application, a novel core assembly is disclosed to enable the use of interchangeable core members that are joined together along a parting line in the coupler shank at a closely-spaced location from the horn line. The outer wall surfaces of the core members at the parting line are contoured so that protrusions are produced on the inside wall surface of the casting. These protrusions extend forwardly toward and beyond the horn line and rearwardly along the coupler shank.

The increased thickness to the shank walls produced by these protrusions provides added strength and fatigue resistant properties. However, the bottom wall forwardly and rearwardly of the horn line is also strengthened in a different manner according to the present invention. The area of the bottom wall presently under discussion has an outer surface contour which is modified according to the present invention so that it is substantially planar from the usual depending spaced-apart rotary shaft walls at the bottom of the coupler head and extending rearwardly along the casting to the recess forming the site for a wear resistant member. In the past, the outer surface of this portion of the bottom wall had a relatively large concave surface across the width of the bottom wall that blended forwardly with the rotary shaft wall.

SUMMARY OF THE INVENTION

It is an object of the present invention to provide improvements in a pattern for a casting used to form a coupler for a railway vehicle wherein the outer surface of the bottom wall forwardly and rearwardly of the horn line of the casting is substantially planar and formed by increasing the thickness to the bottom wall at this site.

It is another object of the present invention to provide a pattern to cast a coupler for a railway vehicle, wherein the bottom wall of the casting has an increased thickness over standard wall thicknesses at the horn line and extending forwardly into the coupler head and rearwardly along the coupler shank.

It is still another object of the present invention to provide an improved drag pattern for a railway coupler casting consisting of any desired configuration of shank and head members produced by selecting corresponding pattern portions and securing these pattern portions onto a drag pattern plate in an abutted end-to-end relation to mold sand in a drag portion of a mold.

It is a further object of the present invention to provide head and shank drag pattern members adapted for abutting together within a plane closely spaced from a plane containing a horn line of the coupler casting to be produced along the shank portion of the pattern and wherein the pattern parts are aligned relative to each other by indexing means carried by a pattern plate to which the pattern parts are releasably secured by fastening members.

The invention resides in producing on a drag mold pattern, a substantially planar surface to produce a coupler casting with the same substantially planar bottom wall surface extending continuously from depending walls from the bottom wall of the coupler head rearwardly beyond a transverse plane containing the horn line and defining the bottom wall surface of the shank portion of the coupler casting to the forward edge of a recessed area therein for receiving a wear resistant attachment.

In the preferred form of the present invention, the drag mold pattern is divided into a head portion and a shank portion along a parting line parallel and adjacent the plane containing the horn line of the coupler casting. The parting line between the pattern parts intersects the aforesaid substantially planar surface. The pattern parts are positioned on a pattern plate by indexing members such as keys and held in an aligned relationship by fastening members such as threaded bolts passed through the pattern plate into tapped holes in the pattern members for the insertion of matching pins.

The pattern parts used to mold sand in a drag mold according to the present invention in its more specific aspect enable the use of various combinations of head and shank core pattern parts to form E-type couplers, E/F-type couplers and F-type couplers.

These features and advantages of the present invention was well as others will be more fully understood when the following description is read in light of the accompanying drawings, in which.

Figure 1:
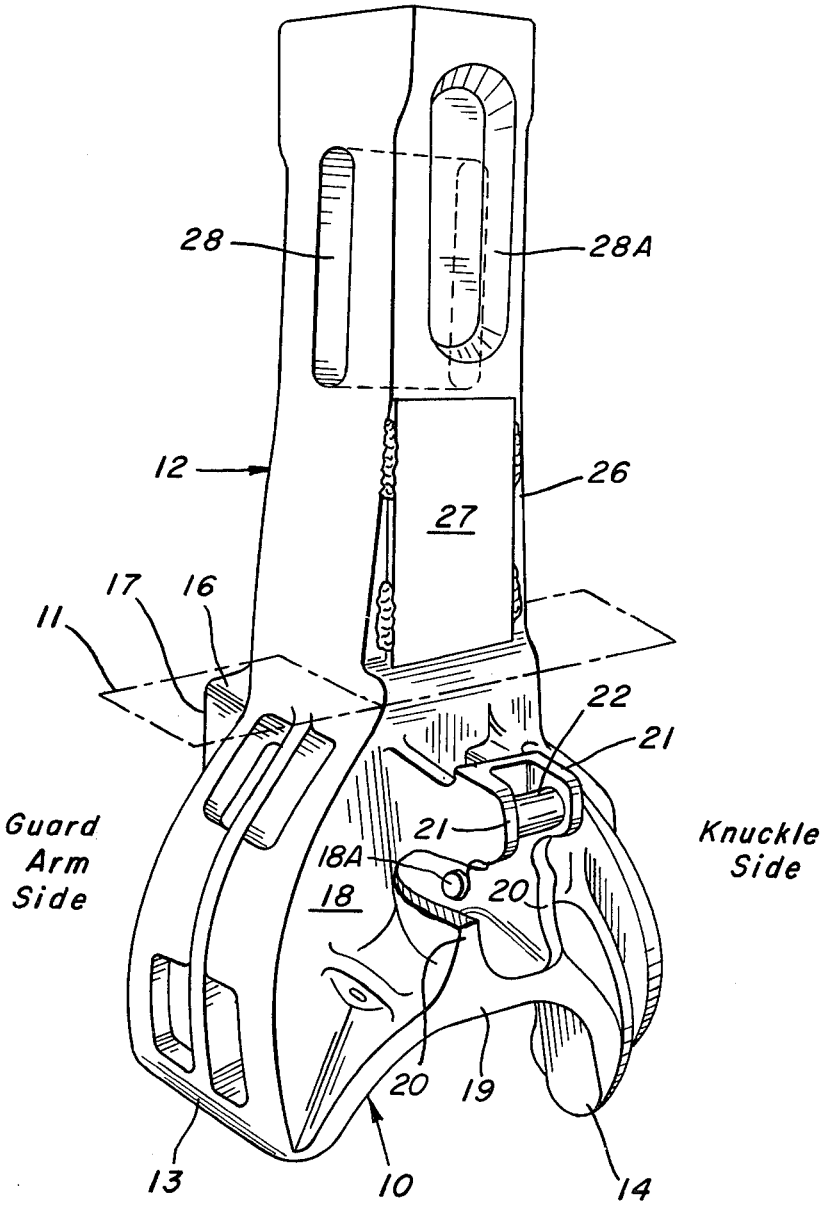
FIG. 1 is a view, in perspective, of a coupler casting produced, in part, through the use of a drag pattern embodying the features of the present invention.

An E-type coupler has been selected for the purpose of disclosing the present invention. While the present invention is addressed to providing a novel pattern surface and arrangement of pattern parts, those skilled in the art will readily understand that pattern surfaces correspond to the actual surfaces formed on the coupler casting since the pattern surfaces are used to produce a sand mold in which molten metal is cast and solidifies to produce the casting. All the surface configurations formed on the drag pattern are not shown in the drawings because they conform to AAR Standards and are well known in the art. In light of the following description, those skilled in the art will recognize that the present invention is equally applicable to E/F-type couplers and F-type couplers. A predominant feature of an E-type coupler is a horizontal key slot in the shank portion of the casting. Predominant features of E/F and F-types of couplers include a vertical pinhole in the shank of the F-type coupler and interlocking lugs and aligning wing pockets on F-type coupler heads. The interlock feature of F-type coupler heads is absent from E-type coupler heads.

Figure 2:
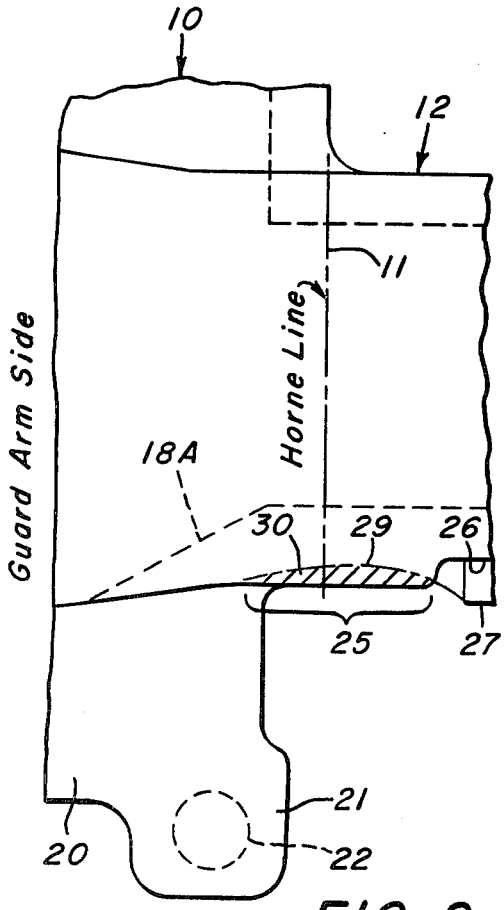
FIG. 2 is a side elevational view from the guardarm side of the couplder casting in the area of the horn line to illustrate the planar bottom wall surface formed by a drag pattern in a sand mold according to the present invention.
Figure 3:
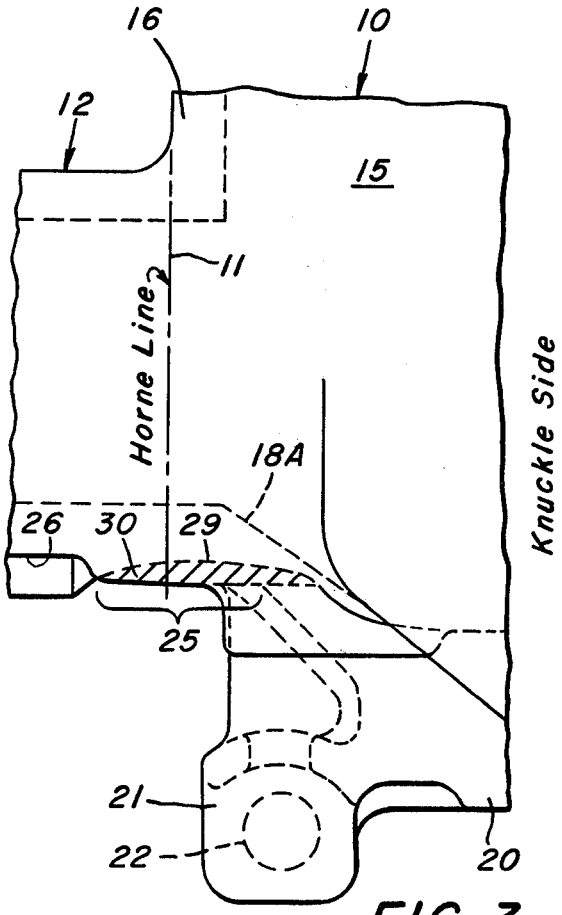
FIG. 3 is a side elevational view similar to FIG. 2 but from the knuckle side of the coupler casting.

The coupler casting shown in FIGS. 1–3 includes an E-type coupler head 10 joined as an integral part of the casting along a transverse vertical plane 11 coincident with the horn line to a coupler shank 12. The coupler head 10 includes a guard arm 13 at one forward side and a knuckle arm at the opposite forward side. A lock chamber 15 is a cored area in the coupler head which is extended by a vertical horn wall 16 and side walls 17 from thetop wall of the coupler head. The rear face surface of the horn wall 16 defines the horn line.

The lock chamber 15 communicates with a bottom lock hole opening 18A in the bottom wall 18 of the coupler head. The opening 18A as shown in FIG. 1, is surrounded by a front face wall 19 and spaced-apart depending lock hole walls 20. The lock hole walls 20 extend rearwardly toward the horn line where they are continued by downwardly-extending rotary shaft walls 21 used to support a rotary shaft 22 which extends between these walls. The rotary shaft 22 is used in the coupler assembly to support linkage used to move a lock member within the lock chamber 15. The internal face surface 18A of the bottom wall in the coupler head, as shown in FIGS. 2 and 3, approaches the horn line in an upward direction.

The present invention is directed to modifications to a drag mold pattern which includes the development of a pattern surface to produce in the resulting coupler casting a substantially planar surface 25 which extends along the sides of rotary shaft walls 21 and continuously from the back edges of these rotary shaft walls rearwardly beyond the horn line 11 and along the coupler shank to a transverse line at which the pattern defines a recess 26 in the bottom wall of the shank. This recess is used to support a wear plate 27 or, alternatively, as disclosed in U.S. Pat. No. 4,081,082, assigned to the same Assignee as this application, one or more parallel beads of hard-facing weld deposits. As shown in FIG. 1, the recess 26 extends rearwardly along the shank to a point spaced from a key slot 28 and a depressed lightener panel 28A. The key slot receives a transverse key used to interconnect the coupler casting to a coupler yoke.

The substantially planar surface 25 provides an increased bottom wall thickness to the coupler casting for a distance of a least 1 inch to either side of the horn line. Portions of the increased wall thickness extends forwardly by as much as 4 inches until the substantially planar surface blends with other surfaces at the front of the bottom wall of the coupler head. The space (represented by cross-hatching) between broken lines 29 and the planar surface is identified by reference numeral 30 and illustrates the metal thickness which has been added to the bottom wall according to the present invention to enhance safety of a railway coupler. This increase to the bottom wall thickness strengthens the coupler casting at a fatigue area of the horn line.

Figure 4:
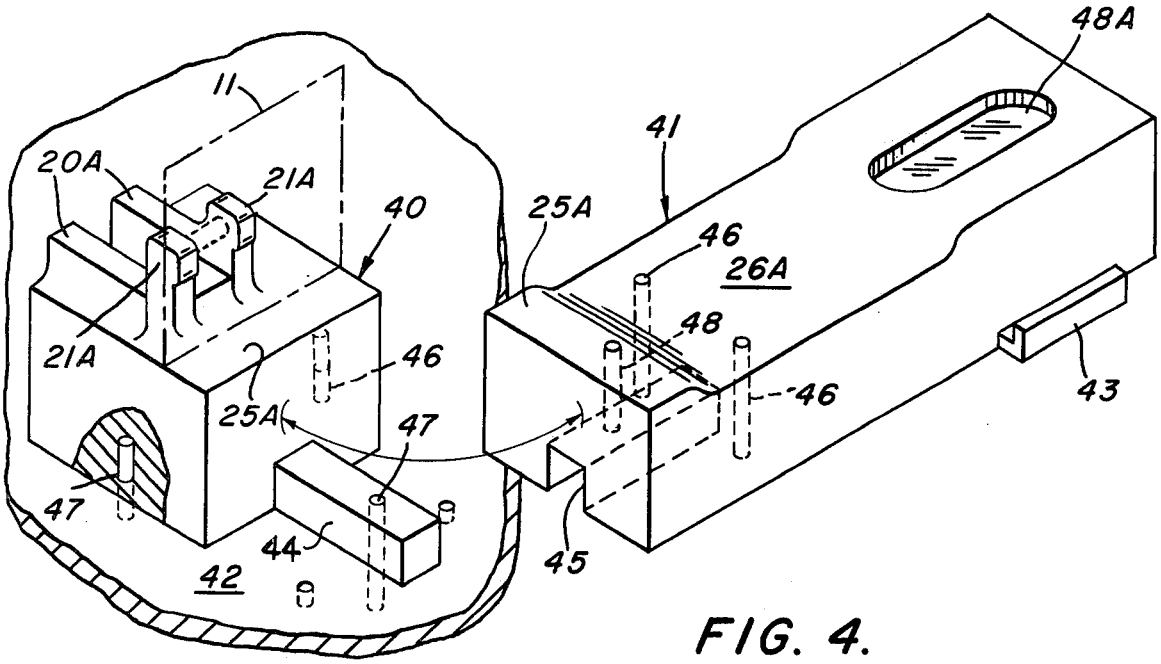
FIG. 4 is a perspective view of drag pattern parts secured to a pattern plate according to the present invention.

FIG. 4 illustrates the preferred form of a drag pattern having a substantially continuous planar surface 25A used for molding sand in a drag half of a mold to produce the surface 25 on the coupler casting shown in FIGS. 1–3. In the preferred form of the present invention, the pattern is actually a pattern assembly made up of three principal parts, namely, a head pattern part 40, a shank pattern part 41 and a pattern plate 42. The head pattern plate includes other pattern surfaces in addition to surface 25A used to mold sand in the drag portion of a mold. The surface characteristic and profile of the bottom half of the coupler head are reproduced in the resultant metal casting. Thus, for example, pattern walls 21A correspond to rotary shaft walls 21 and pattern walls 20A correspond to lock hole walls 20. On the shaft pattern portion 41, surface 26A corresponds to the recess surface 26 of the coupler casting. Pattern projection 43 forms a core print in the sand for the location of a core used to form the key slot 28. A core is used to form the rotary shaft 22 in the resultant casting.

The head pattern part 40 includes a key 44 perpendicular with the horn line. The transverse dimension and configuration of the key corresponds to a key slot 45 in the shank pattern portion 41. The interfitting relation of the key 44 and the key slot 45 facilitates the alignment operation between the pattern parts and maintains this relation during use of the pattern. In FIG. 4 for convenience, the pattern parts are shown in a separated position. However, additional match pins 46 are employed to interconnect the pattern parts. The match pins 46 are received in drilled openings in the pattern plate 42, the shank pattern 41 and head pattern part 40. The key 44 is used not only to assure an aligned relation between the pattern parts but also a desired index relation of the pattern parts on the pattern plate. After the pattern parts are abutted in a face-to-face relation, bolt-type fasteners are passed through openings 47 in the pattern head into the pattern plate and key 44 tapped holes in the pattern plate. A bolt-type fastener is passed through aligned openings 48 in the shank pattern and through the key into a tapped hole in the pattern plate.

In view of the foregoing, it is believed apparent to those skilled in the art that, for example, shank pattern part 41 may be replaced with a pattern part configuration of an F-shank whereby upon assembly of the F-shank pattern part with the pattern part 40, the molded sand pattern in the drag portion of the mold defines the bottom half of an E/F coupler. This interchangeability of pattern parts in extendible to all coupler types. It will be observed, however, that the parting line between the pattern parts is spaced along the coupler shank pattern part by a short distance of, for example, one inch from the horn line 11.

Although the invention has been shown in connection with a certain specific embodiment, it will be readily apparent to those skilled in the art that various changes in form and arrangement of parts may be made to suit requirements without departing from the spirit and scope of the invention.

I claim:

1. A drag mold pattern to produce a sand mold for a coupler casting for a railway vehicle wherein the couplder casting includes a coupler shank extending from a coupler head at a transverse plane coinciding with a horn line defined by the outer rear surface of a vertical horn wall at the top of the coupler head, said horn wall forming part of a lock chamber extending in the coupler head to a lock hole in the bottom wall thereof, the lock hole opening out of the bottom wall of the coupler casting between depending lock hole walls which project rearwardly to a plane short of the horn line to define rotary shaft walls, a rotary shaft in the coupler casting extending between the rotary shaft walls in a generally parallel relationship with the horn line, the bottom wall of the coupler shank including a recessed area to support a wear resistant surface spaced from the horn line, the improvement in said drag mold pattern comprising a drag mold pattern surface defining a substantially planar surface extending continuously from pattern walls defining said rotary shaft walls rearwardly beyond a transverse plane defining said horn line to pattern surfaces defining the forward edge of said recessed area in the bottom wall of the coupler shank.

2. The drag mold pattern according to claim 1 wherein said pattern includes two pattern parts joined together in an abutted relation.

3. The drag mold pattern according to claim 1 wherein said pattern further comprises a coupler head drag pattern part, a coupler shank drag pattern part, a pattern plate to support the pattern parts, and means for fastening the drag pattern parts to said pattern plate.

4. The drag mold pattern according to claim 3 wherein said drag mold pattern further comprises a key carried by one of said pattern parts, and a key slot in the other of said pattern parts arranged for interfitting relation to align the pattern parts for support by said pattern plate.

5. The drag mold pattern according to claim 3 wherein said drag mold pattern further comprises key means to index and align the pattern parts on the pattern plate.

* * * * *